US006394460B1

(12) United States Patent
Leggett et al.

(10) Patent No.: US 6,394,460 B1
(45) Date of Patent: May 28, 2002

(54) ONE-PIECE RAM ELEMENT BLOCK FOR WIRELINE BLOWOUT PREVENTERS

(75) Inventors: Henry H. Leggett, Hallsville; James A. Douty, Longview, both of TX (US)

(73) Assignee: Tuboscope I/P, Houston, TX (US)

( * ) Notice: Subject to any disclaimer, the term of this patent is extended or adjusted under 35 U.S.C. 154(b) by 0 days.

(21) Appl. No.: 09/466,150

(22) Filed: Dec. 17, 1999

(51) Int. Cl.[7] ..... E21B 33/06

(52) U.S. Cl. ..... 277/325; 277/277; 277/324; 277/343

(58) Field of Search ..... 277/324, 325, 277/343, 344; 251/1.3, 1.1, 325

(56) References Cited

U.S. PATENT DOCUMENTS

| | | | | | |
|---|---|---|---|---|---|
| 3,994,472 | A | * | 11/1976 | Williams | 277/324 |
| 4,447,038 | A | * | 5/1984 | Floyd | 277/325 |
| 4,690,411 | A | * | 9/1987 | Van Winkle | 277/325 |
| 4,770,387 | A | * | 9/1988 | Granger | 277/324 |
| 5,906,375 | A | * | 5/1999 | Young et al. | 277/325 |

* cited by examiner

*Primary Examiner*—Anthony Knight
*Assistant Examiner*—Enoch Peavey
(74) *Attorney, Agent, or Firm*—Finnegan, Henderson, Farabow, Garrett & Dunner, LLP

(57) ABSTRACT

Ram seal units for attachment to the rams of blowout preventers incorporate an integral ram seal block having a central web, with a parallel rectangular elastomer support plates extending from opposite sides of the integral ram seal block. The central web is perforate to permit its interlocked relation with elastomer sealing material that is molded to ram seal block. The generally rectangular elastomer support plates define outer face surfaces that remain exposed after the molding operation has been completed. These outer face surfaces of the elastomer support plates are adapted to be disposed in intimate face-to-face relation with internal wall surfaces of ram seal receptacles that are provided within BOP ram elements. Each of the rectangular elastomer support plates defines a pair of spaced retainer receptacles which receive a respective retainer element of a BOP ram to secure the ram seal units in retained relation within one of the ram seal receptacles of a BOP ram element. When so supported, the elastomer sealing material located between the generally rectangular elastomer support plates and encapsulating the central web structure of each integral ram seal block, will be presented for sealing contact with its opposed counterpart of the opposed BOP ram element and with the wireline that is present within the body of the BOP unit.

18 Claims, 5 Drawing Sheets

ONE-PIECE RAM ELEMENT BLOCK FOR WIRELINE BLOWOUT PREVENTERS

BACKGROUND OF THE INVENTION

1. Field of the Invention

This invention relates generally to wireline blowout preventers (BOP's) which are utilized to prevent well blowout when wireline operations are being conducted. More specifically, the present invention concerns wireline blowout preventers which incorporate pressure responsive sealing rams each having a one-piece ram element block for sup port and positioning of an elastomer sealing element for sealing with a wireline and for preventing misalignment of seal support plates especially when the plates are machined to accommodate larger wire sizes.

2. Description of the Prior Art

After a well has been drilled such as for discovery and production of petroleum products, wireline controlled apparatus is frequently employed to conduct various downhole installation, retrieval and servicing operations. Wireline equipment is utilized to install and retrieve a wide variety of downhole tools such as packers, gas lift valves, downhole safety valves, bottom hole pressure sensors and the like. Wireline equipment is also frequently utilized to run various well servicing tools such as for cleaning and treating production tubing. The wireline for supporting and controlling movement of the downhole well tool is payed out from a large diameter spool, typically mounted to a service vehicle, and is run through an elongate lubricator body having an internal grease or lubricant chamber containing grease for maintaining a seal between the wireline and the lubricator body to prevent escape of well pressure as the wireline is moved linearly into and from the well.

At times it is desirable to establish a seal about the wireline to permit well servicing operations to be conducted within the well head and free of well pressure above the blowout preventer (BOP). More importantly, wireline BOP's are required to accommodate various emergency situations and alleviate any dangerous condition that might otherwise occur. During wireline operations the wireline BOP is typically static in an open, non-sealing position which allows the wireline to freely traverse the wellhead of the well without interference with any portion of the wellhead structure including the safety equipment of the wellhead.

At times during well servicing operations it will be necessary to quickly close and seal the wireline BOP about the wireline. For example, in the event a kick develops in the open hole or in the casing of the well, the wireline BOP is closed to develop a seal between the wireline and the BOP body to contain well pressure and prevent a blowout. Such emergency closure and sealing of a BOP can be manually accomplished or it can be automatically operated responsive to the well pressure condition. With well pressure thus contained, kill fluid can be pumped into the well below the seal established by the wireline BOP to counterbalance the well pressure condition and shut in the well. The wireline BOP may also be closed to temporarily maintain well pressure while bleeding off the lubricator of wireline equipment to replace packoff elements. In some cases it becomes necessary to remove, add or make repairs to the riser or cable of the wireline well servicing equipment. In this case the wireline BOP is typically closed and sealed about the wireline cable to thus permit bleeding of pressure from the lubricator riser, enabling cable repairs to be made above the level of the wireline seal within the BOP. Most critically, wireline BOP's are shut automatically or manually in the case of failure of the well control system above the level of the BOP.

Typically, wireline sealing elements are formed by two elastomer faced metal rams which have been contoured to fit a particular size of wireline cable. These rams are positioned in opposed relation and are actuated such that they establish sealing engagement with the wireline positioned centrally of the BOP housing. In other words, the opposed rams center the wireline within the housing and establish a seal about the wireline. The opposed rams are closed manually or hydraulically (with mechanical backup) to shut in the well. When the BOP is activated, the elastomer faces of the rams will seal around the outer surface of the cable by extruding the elastomeric material into the interstitial spaces between the armor strands of the wireline.

The ram elements each define a ram body that is linearly movable within a transversely oriented ram passage or chamber of a BOP body. The ram element include at least one external seal which establishes sealing of the ram body with respect to the internal surface of the ram passage or chamber. At the opposed sealing face of each ram body, the ram body defines at least one and preferably a pair of seal receptacles. Within each seal receptacle is located a seal body, typically comprising an elastomeric sealing body having metal support plate members providing upstream and downstream structural support for the elastomeric sealing body and providing the elastomeric sealing body with sufficient structural integrity to resist the force of pressure differential that might otherwise permit sufficient yielding of the elastomeric sealing body to allow leakage to occur. The metal support plate members also provide the elastomeric sealing body with enhanced structural integrity to resist excessive pressure induced extrusion of the elastomeric material especially in the region of its seal with the wireline. Typically the elastomeric body and the metal support plates are in molded assembly and thus form a ram seal unit than can be replaced when necessary without necessitating replacement of the ram body.

When the ram seal units are manufactured by a molding operation, the metal support members are located within a molding fixture and the elastomeric material is injected in uncured state into the molding fixture and then cured by heating to a suitable temperature range for a predetermined period of time. Since the uncured elastomeric material is quite viscous during molding, the metal support places can be slightly displaced, i.e., moved from side to side, during elastomer injection especially when the support plates are machined to allow for larger wireline size. When the support plates become misaligned during the molding operation, the misaligned wireline recesses of the plates will be misaligned and the resulting wireline channel of the ram seal unit will be improperly constructed. This manufacturing problem can cause the sealing integrity of the ram seal unit to be of less than desirable quality. Additionally, during the molding operation the support plates can become bowed, thus also adversely influencing the sealing capability of the ram seal unit. Another problem that is often encountered during the seal manufacturing process is that the upper and lower support plates can easily become improperly spaced. It is necessary the support plates be disposed in parallel relation and that the spacing of the support plates of each of the ram seals of each of the BOP rams have the same spacing to enable equal elastomer deformation in each of the ram seals in response to a particular pressure differential. It is desirable therefore to provide a ram seal unit that can be easily manufactured in a manner avoiding the above-identified problems.

Ram type BOPS are designed to seal with the wireline cable in a static position. It is necessary therefore to always stop movement of the wireline before the rams are closed about the wireline to effect sealing. Short lengths of wireline cable can be stripped through the BOP as needed to repair a stranded cable but the amount of elastomeric material that can be worn away by such stripping without resulting in leakage of the BOP is limited. Pulling an appreciable length of wireline cable through the BOP will usually induce severe wear or erosion of the elastomeric seals of the rams, resulting in leakage, and can cause damage to the ram s as well, causing a more serious failure.

Under conditions of high differential pressure the elastomeric seal is prevented from pressure induced extrusion by the close metal-to-metal fit of the ram faces and due to the fact that differential pressure moves the cylindrical rams tightly against the upper wall of the BOP housing. When the mechanical pressure of the elastomer against the surrounding surfaces of the BOP body exceed differential pressure across the sealing body a leak-tight seal will be effected. Wireline BOPs are typically designed to seal against well pressure in only one direction and therefore care must be taken to insure that they are not installed upside-down when a single set of rams is employed because in most cases an inverted BOP will not hold well pressure. BOP installations having single ram BOPs are usually only installed upside-down to contain pressure injected from above. BOP units incorporating a centralized grease pack feature between the upstream and downstream ram seal units can have pressure sealing capability both from the standpoint of containing well pressure and containing pressure injected above the BOP seals. In this case the BOP units are not unidirectional and may be installed in an orientation suiting the needs of the user.

It is difficult to move the rams of wireline BOPs when the rams are closed against high differential pressures. Wireline BOPs are therefore typically provided with a pressure equalization system, typically referred to as a bypass, that is used to equalize the pressure across the rams before opening of the rams is initiated. After equalization of well pressure across the rams has occurred, there will be a partial relaxation of the sealing contact of the elastomeric seals with the wireline and with the BOP housing, thus reducing extrusion of the elastomeric sealing material about the wireline and minimizing friction that otherwise tends to resist opening movement of the rams. The effective reduction of friction resulting from pressure equalization across the rams makes the rams much easier to open.

Manual BOPs are operated by turning two ram operator handles on opposed sides of the apparatus to open and close the opposed rams. Manual BOP's are available in a number of sizes and ratings. Regardless of the pressure rating, they are normally used at lower pressures for standard service. Manual BOPs are typically of lighter weight and are less expensive as compared to BOPs having hydraulically energized rams. Because operating personnel must gain physical access to manual BOPs for opening and closing the rams, such personnel is typically in a more dangerous location during these activities. Also, less ram pressure can be applied with manual BOPs than with hydraulically energized ram BOPs. In larger sizes, as commonly used for open hole work, the manual BOP offers adequate protection and is considerably lighter than a hydraulically energized BOP.

Hydraulic ram BOPs are opened and closed by hydraulic pressure acting on pistons in hydraulic cylinders. Hydraulic BOPs also have handles and stems that are used for manual backup. A hydraulic BOP can be closed manually but must be opened hydraulically. The stems must be backed out manually before the rams can be opened hydraulically.

The rams and sealing elements of wireline BOPs have grooves that are sized for the wireline cable diameter being employed. As the rams are, closed, the cable is guided by the rams or other cable guide elements into the grooves of the sealing elements. BOPs are provided with "integral guide" rams that prevent cable damage as the cable is guided and centralized during ram closure. If the rams of hydraulic wireline BOPs are to be left closed for a long period of time or in case of hydraulic failure, the manual screw jack can be used to hold the rams in the closed position. To open a hydraulic wireline BOP, the mechanical backup must be in the open position before shifting the "selector" to its open position and hydraulically pumping the rams to their open positions.

Multiple ram BOPs, typically dual wireline BOPs, are utilized to provide a backup in case of failure of the primary set of sealing rams. More importantly is the fact that gas will tend to migrate through the interstices between the inner and outer armor strands of a stranded type wireline cable. In the event that the lubricator of the wireline equipment would need to be removed for some reason, the leaking gas could quickly present a significant problem from the standpoint of danger to personnel. To alleviate this problem, a second (tandem) BOP is added. This second BOP is inverted if it is designed to hold pressure in only one direction and a port is added between the two BOP's. High pressure grease (above well pressure) is injected into the flow passage between the upper and lower sets of rams. Under high pressure, the grease is caused to migrate into the interstitial spaces between the inner and outer armor strands of the wireline and thereby effects an interstitial grease seal to prevent gases from escaping. In some cases a triple BOP is also available which provides a backup in the case of primary ram failure. A triple BOP also provides a method for injection of grease between the BOPs if needed. Multiple ram BOPs are available in a single forged body for lighter weight and more compact size.

As explained, it is frequently necessary to employ dual and sometimes triple wireline BOPs and to provide for grease injection between them in order to effect a proper wireline seal and prevent migration of gases through the interstices of the wireline. Since the flow passage between the stacked or multiple wireline BOPs is typically of significant length and is at least as great as the diameter of the flow passage through the wireline, a considerable volume of injected grease is necessary to accomplish efficient sealing. Also, injection of a sufficient volume of grease to fill the flow passage and develop a hydraulic seal with the wireline can require a considerable period of time. It is desirable to minimize the time required to develop an adequate hydraulic seal with the wireline to thus promote the safety of the sealing operation.

SUMMARY OF THE INVENTION

It is a principal feature of the present invention to provide a novel sealing ram construction for blowout preventers, particularly wireline blowout preventers which incorporates an integral ram seal block to which elastomer sealing material is molded and which integral ram seal block provides integral support plate structures for resisting elastomer extrusion when the BOP rams are closed and subjected to significant pressure differential;

It is another feature of the present invention to provide a novel sealing ram construction for blowout preventers which eliminates the potential for support plate twisting, misalignment, lateral shifting, etc. during manufacture of ram seal units for attachment to the rams of blowout preventers;

It is also a feature of the present invention to provide a novel sealing ram construction for blowout preventers which simplifies and minimizes the cost of manufacture of ram seal units for blowout preventers without sacrificing the quality thereof;

Briefly, ram seal units for attachment to the rams of blowout preventers, manufactured within the spirit and scope of the present invention, incorporate an integral ram seal block having a central web structure, with a pair of generally rectangular elastomer support plates extending from opposite sides of the integral ram seal block and being disposed in parallel relation. The central web structure is perforate to permit its interlocked relation with elastomer sealing material that is molded to ram seal block The generally rectangular elastomer support plates define outer face surfaces that remain exposed after the molding operation has been completed. These outer face surfaces of the elastomer support plates are adapted to be disposed in intimate face-to-face relation with internal wall surfaces of ram seal receptacles that are provided within BOP ram elements. Each of the rectangular elastomer support plates defines a pair of spaced retainer receptacles which receive a respective retainer element of a BOP ram to secure the ram seal units in retained relation within one of the ram seal receptacles of a BOP ram element. When so supported, the elastomer sealing material located between the generally rectangular elastomer support plates and encapsulating the central web structure of each integral ram seal block will be presented for sealing contact with its opposed counterpart of the opposed BOP ram element and with the wireline that is present within the body of the BOP unit.

Each of the plurality of ram seal units of opposed BOP rams will be adapted for the size of the wireline for which the BOP unit is designed. After the molding operation has been completed the ram seal units will be machined to define a wireline groove of proper size to fit the wireline. Alternatively, before the molding operation is initiated, the integral metal ram seal block can be machined to define a wireline groove of proper size and centralized location in the spaced support plate structures thereof. The elastomer molding operation can then be carried out to form a wireline groove in the elastomer material which may be of different dimension as compared with the wireline groove in the support plates to accommodate displacement of the elastomer sealing material by the mechanical force holding the sealing faces of the rams in sealing contact. As a further alternative, subsequent to the molding operation, the elastomer material can be separately machined in the region of the wireline groove to form a wireline groove in the elastomer material which can be of different dimension as compared with the wireline groove machined in the support plates of the integral metal ram seal block.

After the elastomer sealing material has been molded to each of the integral ram seal blocks and the wireline groove has been formed in each of the ram seal units, the ram seal units are then installed within respective receptacles formed in the sealing face of the BOP ram elements. Typically, each of the BOP ram elements will define a pair of spaced ram seal receptacles which are disposed in spaced relation. The space between the ram seal units can be employed to define a small volume grease receptacle, such as the case when the opposed BOP rams and ram seals form a grease pack BOP sealing system of the general nature disclosed in U.S. Pat. No. 4,93 8,290 of Henry H. Leggett, et al.

Since the elastomer support plates are integrally formed with the integral ram seal block, plate misalignment, bending, twisting or shifting during the molding process will not occur. The plate structures will remain precisely parallel during the molding operation so that the outer plate surfaces will precisely fit in face-to-face relation with the internal planar surfaces of the ram seal receptacles of the BOP ram elements.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof It is to be noted however, that the appended drawings illustrate only a typical embodiment of this invention and are therefore not to be considered limiting of its scope, for the invention may admit to other equally effective embodiments.

In the Drawings.

DETAILED DESCRIPTION OF PREFERRED EMBODIMENT

Figure 1:
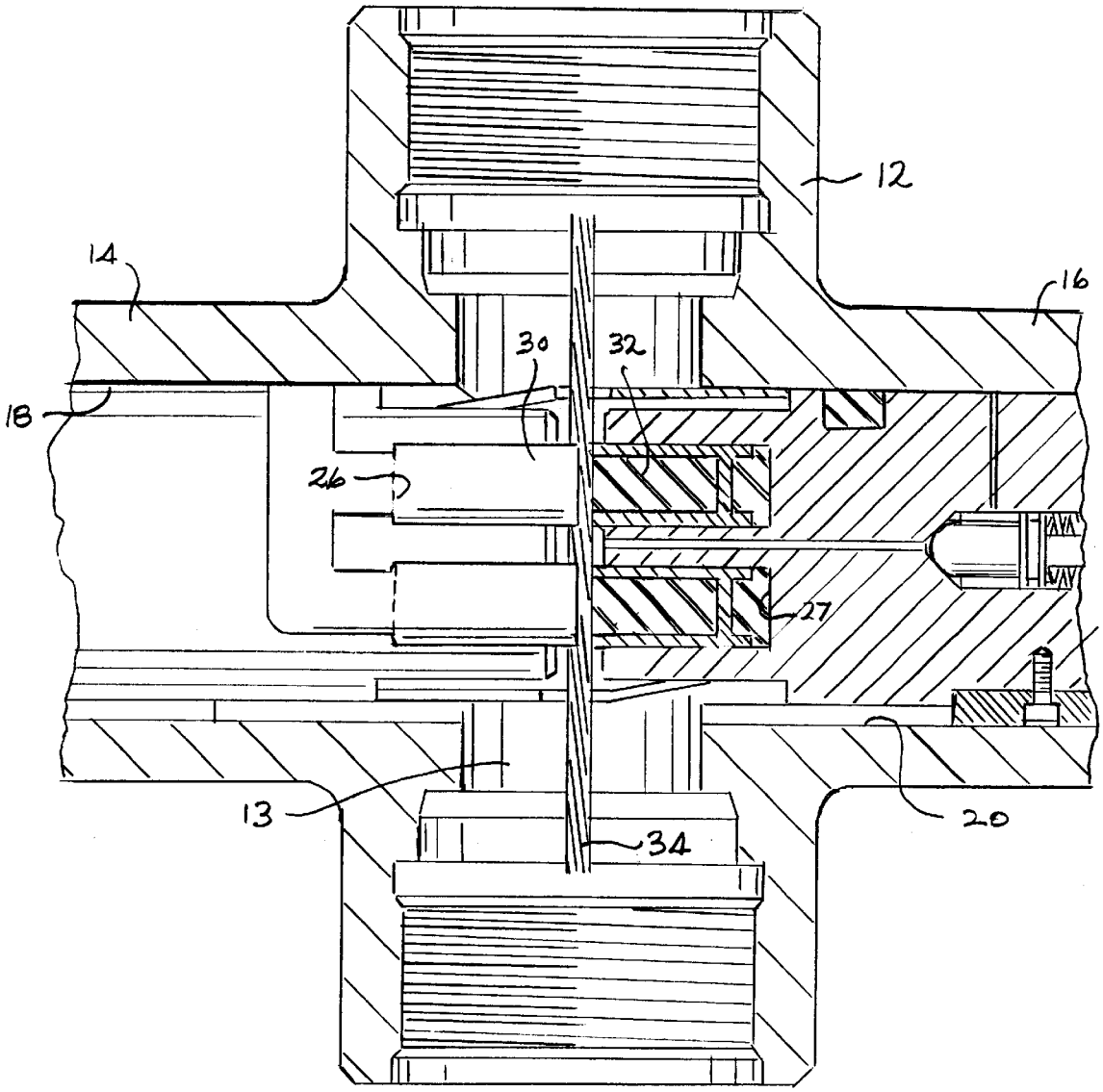
FIG. 1 is a sectional view of a wireline BOP having retained therein a pair of ram seal assemblies constructed in accordance with the principles of the present invention.

Referring now to the drawings and first to FIG. 1, there is shown a wireline blowout preventer (BOP) 10 having a BOP housing 12 defining a generally vertically oriented bore or passage 13 through which a wireline extends for wireline operations and through which well tools pass for well service operations and through which fluid flow may occur. Typically the BOP housing is temporarily assembled to the wellhead of the well so that wireline operations may be conducted and is removed after wireline operations have been completed. The BOP housing defines a pair of opposed ram housings 14 and 16 which are typically integral with the BOP housing, but which may be connected with the BOP housing by bolting, welding or by any other suitable means of connection. The ram housings 14 and 16 define internal ram bores 18 and 20 within which are linearly movable a pair of ram elements 22 and 24 which having sealed relation within the ram bores and are pressure actuated to the closed positions thereof responsive to detection of an abnormal pressure condition within the well and below the BOP. The rams 22 and 24 define seal receptacles 26 and 28 which are each adapted to contain a respective ram seal assembly 30 and 32 for establishing a seal with the wireline 34 when the rams 22 and 24 are pressure actuated to the closed positions thereof or when the rams are manually actuated to their closed positions if the BOP is designed for manual actuation or override.

Figure 2:
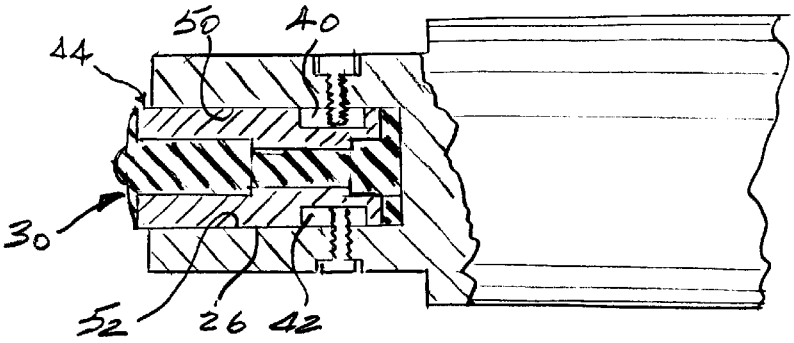
FIG. 2 is a fragmentary sectional view of a single ram embodiment wireline BOP showing the ram seal assembly being retained within a ram seal receptacle of the pressure actuated ram of the BOP unit.
Figure 3:
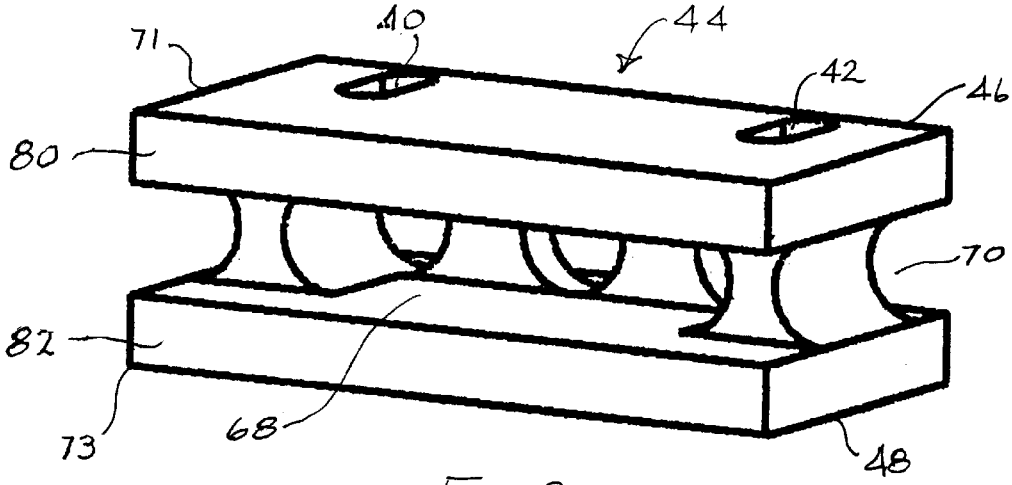
FIG. 3 is an isometric illustration of an integral ram seal block that is constructed in accordance with the principles of the present invention shown prior to molding of the sealing material thereto.
Figure 4:
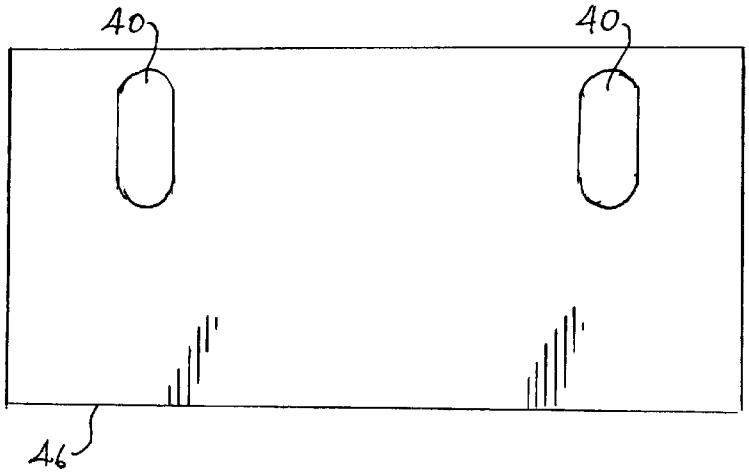
FIG. 4 is a plan view of the integral ram seal block of FIG. 3, showing the spaced upper retainer receptacles thereof.
Figure 5:
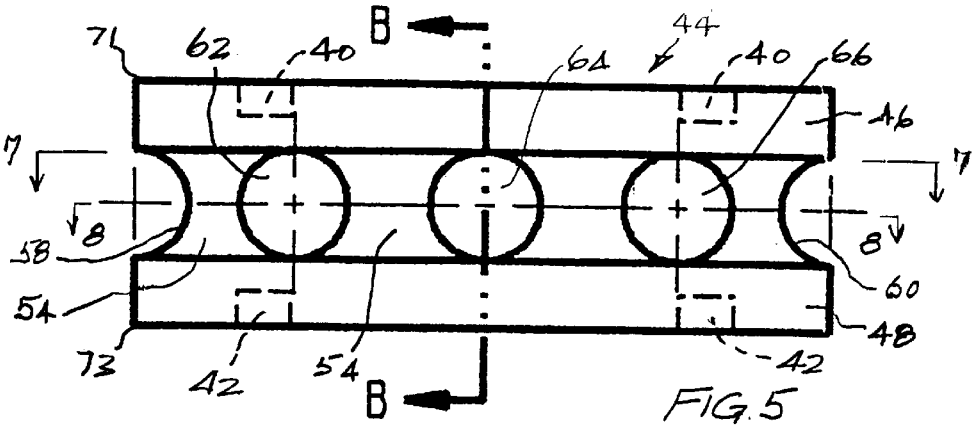
FIG. 5 is a front elevational view of the integral ram seal block of FIGS. 3 and 4.
Figure 6:
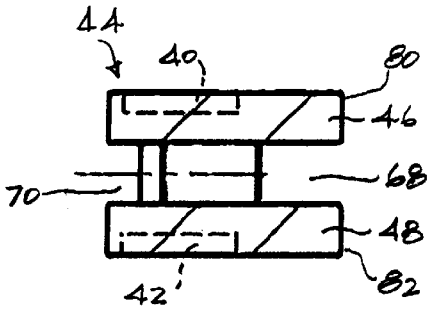
FIG. 6 is a side elevational view of the integral ram seal block of FIGS. 3, 4 and 5.
Figure 7:
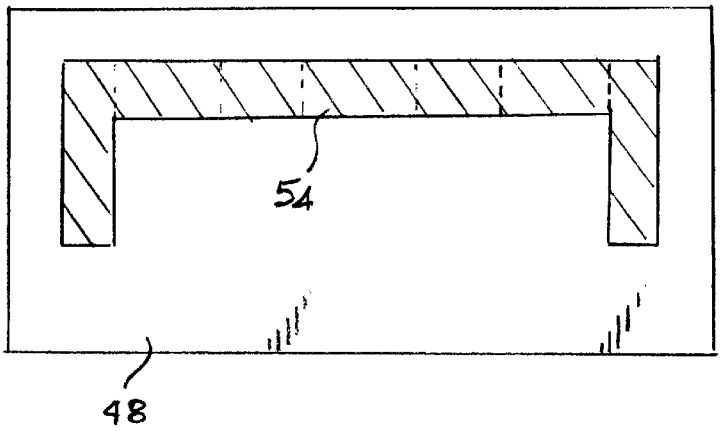
FIG. 7 is a sectional view taken along line 7—7 of FIG. 5.
Figure 8:
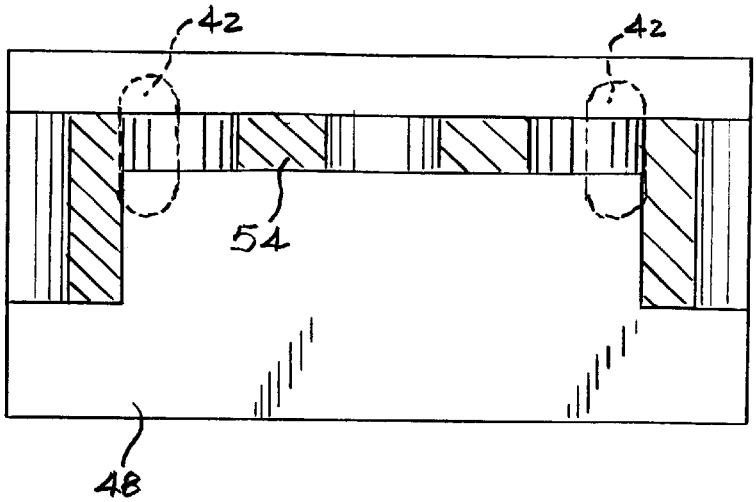
FIG. 8 is a sectional view taken along line 8—8 of FIG. 5.

As shown in the fragmentary sectional view of FIG. 2, the ram seal assembly 30 is shown seated within its receptacle 26, with opposed pairs of retainer key elements 36 and 38 seated within opposed pairs of key receptacles 40 and 42 of an integral ram seal block which is shown generally at 44 in the various FIGS.

Referring to FIGS. 3–8, the integral ram block 44 of the present invention defines a pair of spaced generally parallel related seal support plate elements 46 and 48 which are disposed in close proximity with internal substantially parallel wall surfaces 50 and 52 of the respective seal receptacle 26. Each of the seal support plate elements 46 and 48 define a pair of spaced retainer key receptacles 40 and 42 respectively which receive retainer key elements 36 and 38 which are actuated by threaded retainer key actuators 50 and 52 which may take the form of retainer bolts that are manually actuated to retain the ram seal assemblies within their respective receptacles of the rams. The retainer key actuators may take any other suitable form for securing the respective ram seal assemblies within their respective ram receptacles. The seal support plate elements 46 and 48 are maintained in spaced, generally parallel relation by a web structure 54 which is preferably defined by machining away metal structure to define the space between the seal support plate elements. To ensure integrated assembly or connection of sealing material 56 to the integral ram block 44, the web structure defines side relief surfaces 58 and 60 which are shown as curved, but which may have any other suitable geometric form without departing from the spirit and scope of the present invention. This feature permits molded elastomer material to fill these side relief grooves so that the elastomer sealing material will be of sufficient thickness at the sides of the integral ram block for retention in assembly therewith so that it will not be pulled away from the ram block structure when subjected to significant pressure differential across the ram seal after pressure responsive closure of the BOP rams. The web structure of the integral ram block 44 is also machined in a manner defining a plurality of openings 62, 64 and 66 which permit the elastomer sealing material to extend through the web when molded to the integral ram block and to establish an interlocking relation with the metal structure of the ram block which prevents separation of the elastomer sealing material from the metal structure of the integral ram block. As shown particularly in FIG. 6, the integral ram block is machined in a manner defining front and rear sealing material recesses 68 and 70, respectively, which permit the molded elastomer sealing material to fill these front and rear recesses and penetrate through the web openings so that the molded elastomer sealing material in the front and rear recesses will be mechanically interlocked with the front and rear sections of the integral ram block 44.

Figure 9:
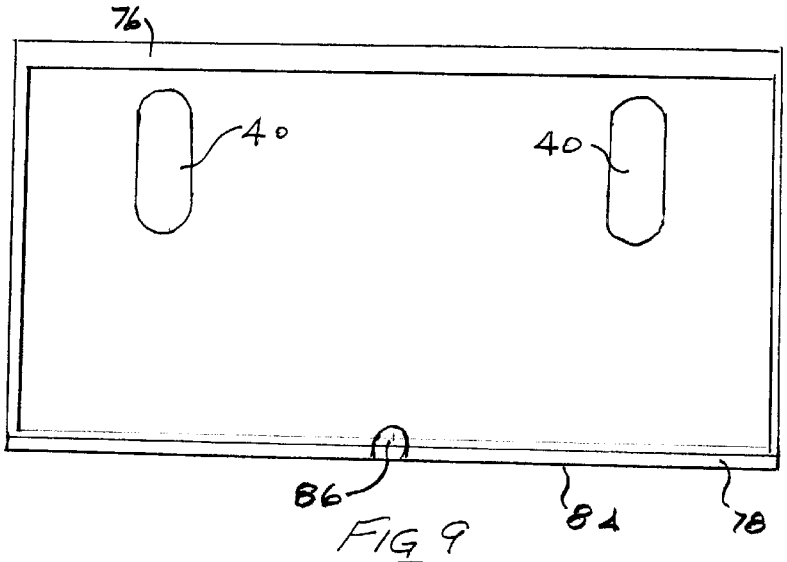
FIG. 9 is a plan view of the integral ram seal block of FIG. 3, showing elastomer sealing material in molded assembly therewith.
Figure 10:
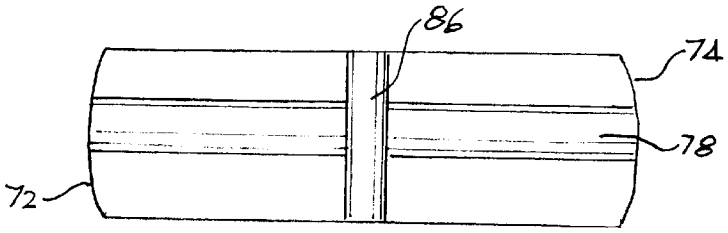
FIG. 10 is a front elevational view of the integral ram seal block of FIG. 9.
Figure 11:
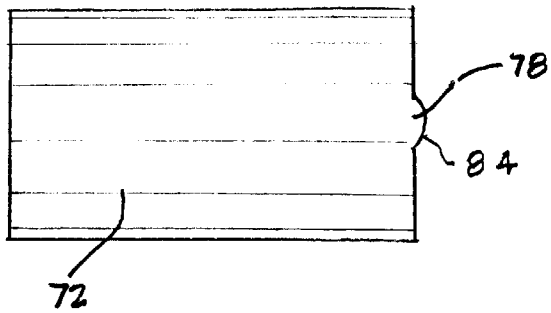
FIG. 11 is a side elevational view of the integral ram seal block of FIG. 9.
Figure 12:
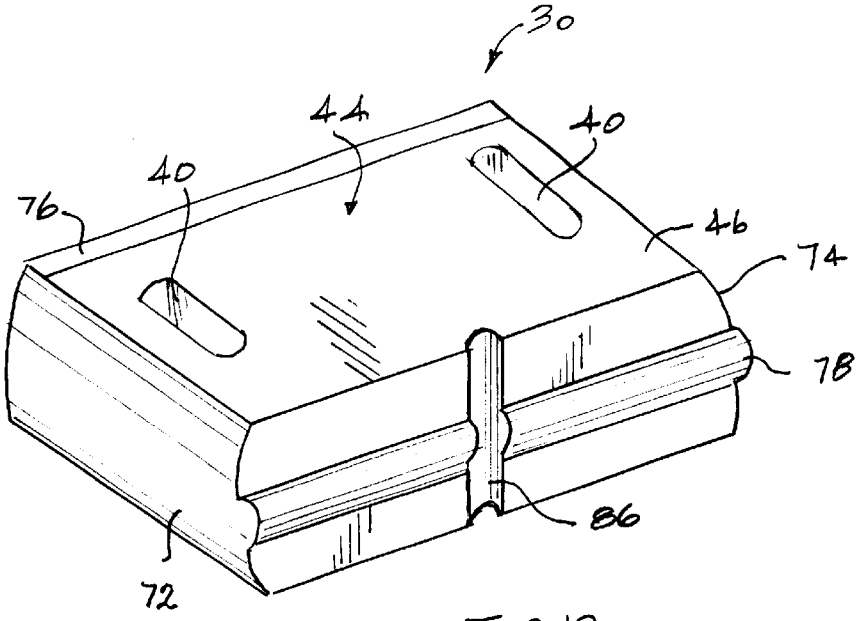
FIG. 12 is an isometric illustration similar to that of FIG. 3 and showing molded elastomer sealing material in molded assembly with the integral ram block.
Figure 13:
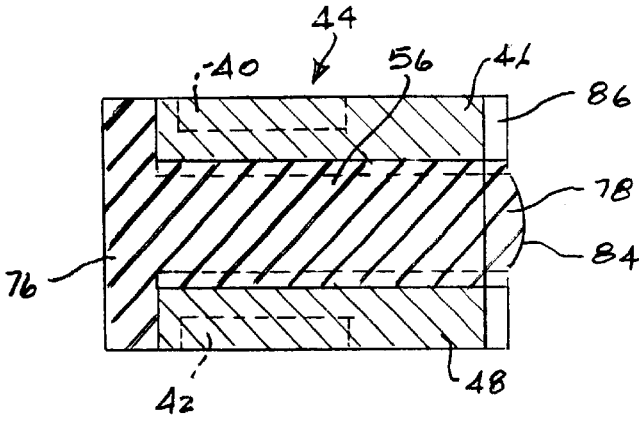
FIG. 13 is a sectional view taken along line 13—13 of FIG. 9 and showing the elastomer sealing material being in molded assembly with the integral ram block.

During the molding process, the mold is designed to receive the integral ram block 44 and to define mold cavities externally of rear, sides and front of the integral ram block. These external mold cavities permit the formation of curved or rounded elastomer side elements 72 and 74 shown particularly in FIGS. 9, 10 and 12. These curved or rounded elastomer side elements are gently curved and intersect the upper side edge corner 71 of the upper seal support plate 46 and the lower side edge corner 73 of the lower seal support plate 48. These curved or rounded elastomer side elements of the elastomer sealing material permit the thickness of the elastomer material to be sufficiently great at the sides of the ram seal assemblies to provide the elastomer sealing material in these regions of the ram seal assembly to have sufficient structural integrity to resist pressure induced displacement when the ram seal units are subject to significant pressure differential in the closed positions thereof.

At the rear portion of the ram seal assemblies, the external cavities about the metal integral ram block provide a rear, generally rectangular strip of elastomer material 76 which has enhanced structural integrity due to its thickness to thus minimize the potential for pressure responsive displacement of the sealing material from the rear portion of the ram seal assemblies. The rear, generally rectangular strip of elastomer sealing material 76 also functions to enhance the sealing relationship of the ram seal assemblies within the ram seal receptacles 26 and 27. As the ram seal assemblies are subjected to mechanical force as the BOP rams are closed under pressure actuation, the rear strip 76 of elastomer sealing material of each ram is mechanically deformed so that it completely fills the rear of the respective ram seal receptacle and provides an efficient seal with the rear inner surface of the ram seal receptacle and thus defines an efficient seal between the ram seal assembly and the ram. This feature effectively prevents fluid pressure from bypassing the ram seal and leaking, even though the sealing faces of the rams are establishing efficient sealing with one another and with the wireline.

At the front section of each of the ram seal assemblies, the external cavities of the molds develop a horizontal face sealing bar 78 of elastomer sealing material which projects beyond the front edges 80 and 82 of each of the seal support plates 46 and 48. The elongate, generally horizontal sealing bar 78 defines a curved face sealing surface 84. The curved face sealing surfaces of the opposed ram seal assemblies establish essentially line sealing contact when they make initial contact with one another as the rams close. Then, as the rams close further, the external curved surfaces of the elongate sealing bars will be displaced by mechanical force so that the region of higher sealing pressure will occur centrally of the external sealing bar or rib. This feature permits sealing of the BOP seal assemblies when they make initial contact, so that low pressure sealing is accomplished. As the mechanical force of ram closure increases, the pressure containing capability of the ram seal assemblies also increases in corresponding fashion.

After the molding operation has been completed, the ram seal assemblies are machined to define a wireline slot 86 of curved cross-sectional configuration which has a dimension corresponding to the dimension of the wireline that is intended. The wireline slot 86 will be formed in the elastomer sealing material at the sealing face of each ram seal assembly and will also be formed in the spaced seal support plates 46 and 48 as shown in FIGS. 9, 10, 12 and 13.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A ram seal assembly for a wireline BOP having pressure energized ram elements each defining a seal receptacle comprising:

(a) an integral ram seal block having spaced, generally rectangular seal support plate elements;

(b) a web structure being integral with said spaced, generally rectangular seal support plate elements in substantially parallel spaced relation; and (c) a quantity of elastomer sealing material being molded to said integral ram seal block and filling the space between said spaced, generally rectangular seal support plate elements and defining a sealing face surface, said surface having a face sealing rib having an external curved surface and projecting forwardly from said sealing face surface and disposed for sealing contact with the face sealing rib of the opposed ram seal assembly for sealing engagement with a wireline extending through the wireline BOP.

2. The ram seal assembly of claim 1, comprising:

said web structure being perforate to permit penetration of elastomer sealing material therethrough.

3. The ram seal assembly of claim 1, comprising:

(a) said web structure defining side relief recesses located between said spaced, generally rectangular seal support plate elements; and (b) said quantity of elastomer sealing material filling said side relief recesses and defining elastomer side surfaces of said ram seal assembly.

4. The ram seal assembly of claim 3, comprising:

said elastomer side surfaces being of curved configuration and having a central portion thereof projecting beyond respective side edges of said spaced, generally rectangular seal support plate elements.

5. The ram seal assembly of claim 3, comprising:

(a) said spaced generally rectangular seal support plate elements being an upper seal support plate having an upper side edge corner and a lower seal support plate having a lower side edge corner; and (b) said elastomer side surfaces being of a curved configuration intersecting said upper side edge corner of said upper seal support plate and intersecting said lower side edge corner of said lower seal support plate.

6. The ram seal assembly of claim 1, comprising:

(a) said spaced generally rectangular seal support plate elements each defining a pair of retainer recesses; and (b) seal retainer elements being carried by said ram elements and engaging within said seal retainer recesses for retaining said ram seal assemblies within said seal receptacles of said ram elements.

7. The ram seal assembly of claim 1, comprising:

(a) said web structure partitioning the space between said spaced generally rectangular seal support plate elements and defining front and rear sealing material recesses;

(b) said quantity of elastomer sealing material filling said rear sealing recess and projecting rearwardly of said spaced generally rectangular seal support plate elements and define a rear strip of elastomer sealing material for sealing the rear of said ram seal assembly within said seal receptacle.

8. The ram seal assembly of claim 1, comprising:

said web structure partitioning the space between said spaced generally rectangular seal support plate elements and defining front and rear sealing material recesses.

9. The ram seal assembly of claim 8, comprising:

said face sealing rib being disposed intermediate said spaced generally rectangular seal support plate elements and intersecting opposed sides of said ram seal assembly.

10. The ram seal assembly of claim 8, comprising:

said face sealing rib being disposed intermediate said spaced generally rectangular seal support plate elements and intersecting opposed sides of said ram seal assembly.

11. The ram seal assembly of claim 1, comprising:

(a) said web structure partitioning the space between said spaced generally rectangular seal support plate elements and defining front and rear sealing material recesses;

(b) said quantity of elastomer sealing material filling said rear sealing recess and projecting rearwardly of said spaced generally rectangular seal support plate elements and define a rear strip of elastomer sealing material for sealing the rear of said ram seal assembly within said seal receptacle; and (c) said quantity of elastomer sealing material filling said front sealing recess and defining said face sealing rib.

12. The ram seal assembly of claim 1, comprising:

said spaced generally rectangular seal support plate elements and said quantity of elastomer sealing material defining a wireline groove of a dimension for receiving a wireline of predetermined diameter.

13. A ram seal assembly for a wireline BOP having opposed pressure energized ram elements each defining a seal receptacle comprising:

(a) an integral ram seal block having spaced, generally rectangular seal support plate elements;

(b) a web structure being integral with said spaced, generally rectangular seal support plate elements and supporting said generally rectangular seal support plate elements in substantially parallel spaced relation, said web structure defining a sealing face surface, said surface having a face sealing rib having an external curved surface and projecting forwardly from said sealing face surface and disposed for sealing contact with the face sealing rib of the opposed ram seal assembly for sealing engagement with a wireline extending through the wireline BOP.

14. The ram seal assembly of claim 13, comprising:

said web structure being perforate to permit penetration of elastomer sealing material therethrough.

15. The ram seal assembly of claim 13, comprising:

(a) said spaced generally rectangular seal support plate elements being an upper seal support plate having an upper side edge corner and a lower seal support plate having a lower side edge corner; and b) said elastomer side surfaces being of a curved configuration intersecting said upper side edge corner of said upper seal support plate and intersecting said lower side edge corner of said lower seal support plate.

16. The ram seal assembly of claim 13, comprising:

said web structure being perforated to permit penetration of elastomer sealing material therethrough and partitioning the space between said spaced generally rectangular seal support plate elements and defining front and rear sealing material recesses.

17. The ram seal assembly of claim 16, comprising:

(a) said face sealing rib being disposed intermediate said spaced generally rectangular seal support plate elements and intersecting opposed sices of said ram seal assembly; and (b) said face sealing rib being disposed intermediate said spaced generally rectangular seal support plate elements and intersecting opposed sides of said ram seal assembly.

18. The ram seal assembly of claim 13, comprising:

said spaced generally rectangular seal support plate elements and said quantity of elastomer sealing material defining a wireline groove of a dimension for receiving a wireline of predetermined diameter.

* * * * *

UNITED STATES PATENT AND TRADEMARK OFFICE

CERTIFICATE OF CORRECTION

PATENT NO. : 6,394,460 B1
DATED : May 28, 2002
INVENTOR(S) : Henry H. Leggett et al.

It is certified that error appears in the above-identified patent and that said Letters Patent is hereby corrected as shown below:

Title page,
Item [57], ABSTRACT,
Line 3, before "parallel", delete "a"; and

Column 12,
Line 5, "sices" should read -- sides --.

Signed and Sealed this

First Day of October, 2002

*Attest:*

*Attesting Officer*

JAMES E. ROGAN
*Director of the United States Patent and Trademark Office*